US009511615B2

(12) United States Patent
Isserstedt

(10) Patent No.: US 9,511,615 B2
(45) Date of Patent: Dec. 6, 2016

(54) BINDER CLIP

(71) Applicant: Robert Kurt Isserstedt, Saltzburg (AT)

(72) Inventor: Robert Kurt Isserstedt, Saltzburg (AT)

( * ) Notice: Subject to any disclaimer, the term of this patent is extended or adjusted under 35 U.S.C. 154(b) by 6 days.

(21) Appl. No.: 14/407,854

(22) PCT Filed: Jul. 18, 2013

(86) PCT No.: PCT/GB2013/051920
§ 371 (c)(1),
(2) Date: Dec. 12, 2014

(87) PCT Pub. No.: WO2014/016568
PCT Pub. Date: Jan. 30, 2014

(65) Prior Publication Data

US 2015/0165811 A1 Jun. 18, 2015

(30) Foreign Application Priority Data

Jul. 23, 2012 (GB) ..... 1213067.0
Jan. 21, 2013 (GB) ..... 1300998.0

(51) Int. Cl.
*B42F 1/00* (2006.01)
*B42F 1/04* (2006.01)

(52) U.S. Cl.
CPC ..... *B42F 1/006* (2013.01); *B42F 1/04* (2013.01); *Y10T 24/20* (2015.01); *Y10T 24/202* (2015.01); *Y10T 24/203* (2015.01); *Y10T 24/204* (2015.01); *Y10T 24/205* (2015.01)

(58) Field of Classification Search
CPC ..... B42F 1/006; B42F 1/04; Y10T 24/203; Y10T 24/202; Y10T 24/204; Y10T 24/205; Y10T 24/20
See application file for complete search history.

(56) References Cited

U.S. PATENT DOCUMENTS 1,133,388 A 3/1915 Merrill et al.
2,134,177 A * 10/1938 Ellis ..... B42F 17/00 24/67.5
2,176,567 A * 10/1939 Ellis ..... B42D 12/00 24/67.5
4,761,862 A * 8/1988 Hiromori ..... B42F 1/04 24/67.5
4,802,263 A 2/1989 Lorber
D321,209 S 10/1991 Hiromori
5,533,236 A 7/1996 Tseng
(Continued)

*Primary Examiner* — Robert J Sandy
*Assistant Examiner* — Louis Mercado
(74) *Attorney, Agent, or Firm* — O'Shea Getz P.C.

(57) ABSTRACT

A binder clip includes a clamping member of spring steel having jaws interconnected by a transverse portion, and a pair of handles each formed of two legs mounted at spaced positions to adjacent the free ends of the jaws. A portion of one leg of one handle extends adjacent one edge of a jaw of the clamping member to adjacent the transverse portion, where another portion of the leg is directed inwardly; and a portion of the other leg of that handle extends adjacent the other edge of the jaw of the clamping member to adjacent the transverse portion, where another portion of the leg is directed inwardly. There is thus provided a space between the two legs so that an element such as a label holder can be mounted on the jaw of the clamping member, without interference from the legs of the handle.

16 Claims, 11 Drawing Sheets

(56) References Cited

U.S. PATENT DOCUMENTS

| | | | | |
|---|---|---|---|---|
| 5,896,624 | A * | 4/1999 | Horswell | B42F 1/006 24/545 |
| 6,226,840 | B1 * | 5/2001 | Lu | B42F 1/006 24/558 |
| 6,363,941 | B1 * | 4/2002 | Combs | A24F 13/22 131/187 |
| 6,374,463 | B1 | 4/2002 | Kaufman | |
| D478,352 | S * | 8/2003 | Huang | D19/65 |
| 7,730,593 | B1 | 6/2010 | Juilly | |
| 7,921,525 | B1 | 4/2011 | Lucas | |
| 9,199,506 | B2 * | 12/2015 | Lim | B42F 1/006 |
| 2005/0060923 | A1 | 3/2005 | Ardern | |
| 2010/0313393 | A1 * | 12/2010 | Kim | B42F 1/006 24/67 R |
| 2011/0047761 | A1 | 3/2011 | O'Donnell | |
| 2011/0047762 | A1 * | 3/2011 | O'Donnell | A45C 1/06 24/557 |
| 2015/0165811 | A1 * | 6/2015 | Isserstedt | B42F 1/006 24/67.5 |
| 2015/0342313 | A1 * | 12/2015 | Antinone | B42F 1/08 342/357.51 |

* cited by examiner

BINDER CLIP

This application is entitled to the benefit of, and incorporates by reference essential subject matter disclosed in PCT Application No. PCT/GB2013/051920 filed on Jul. 18, 2013, which claims priority to Great Britain Application No. 1213067.0 filed Jul. 23, 2012 and Great Britain Application No. 1300998.0 filed Jan. 21, 2013.

BACKGROUND OF THE INVENTION

1. Technical Field

This invention relates to a binder clip for clamping together sheets of paper or the like.

2. Background Information

A typical binder clip comprises a clamping member having first and second jaws interconnected by a transverse portion. Each jaw provides a face extending laterally between a pair of side edges, and extending from a first end at the connection to the transverse portion to a second, free end remote from the transverse portion. The first and second jaws converge from the transverse portion to free ends and there is a clamping force so that items positioned between the free ends of the jaws can be clamped. A handle is provided for each jaw. Each handle comprises a member which has been bent to provide a pair of spaced legs which are connected to a gripping part. Adjacent the free end of each jaw, between the side edges, are provided two laterally directed tubular portions. Each leg terminates in a laterally directed end portion, which is received in a respective tubular portion. In this manner, each handle is mounted to its respective jaw for pivotal movement between a first position in which the legs extend over the face of the jaw to adjacent the transverse portion, and then beyond the transverse portion to the gripping part; and a second position in which the leg projects away from the jaw. When the handles are in their first positions, by squeezing together the first and second gripping parts of the respective handles, the free ends of the jaws are urged apart against a restoring force.

Typically, the clamping member is made from a single piece of material such as spring steel, and the restoring force comes from flexion where each jaw meets the transverse portion and/or flexion of the jaws and/or flexion of the transverse portion.

In a conventional binder clip, the legs extend across central regions of the faces of the jaws.

It has been proposed to attach a label to a binder clip, for example to identify documents which are retained by the binder clip, but the proposals for doing this have various drawbacks. In U.S. Pat. No. 7,730,593, a label is provided on the transverse portion of the clamping member, but this is inconvenient as the label cannot be seen when looking face on at the items held by the clip. In U.S. Design Pat. 321209, an item is attached to a handle but this has may be damaged or dislodged when the handles are squeezed together. Furthermore, the handles may pivot between the first and second positions, and a label attached to a handle would not be readable when in both of these positions if it was only on one side.

In U.S. Pat. No. 1,133,388, a label is attached to one of the jaws of a clip, but this is a different type of clip. When the same is attempted with a binder clip of the type described above, the result is as shown in FIGS. 7 and 8 of US 2011/047761. The legs of the handle extend over the label when in the first position.

An alternative arrangement is disclosed in US 2005/060923, where a sleeve is mounted over the clip. This can display information on both jaws and the transverse portion, but the legs of the handle extend over the label when in the first position.

In U.S. Pat. No. 5,533,236, there is disclosed an arrangement in which a portion of each handle leg extends over the face of its respective jaw to adjacent a side edge of the jaw, in the region of the free end of the jaw. The handle is mainly in the shape of a triangle, and the two laterally directed end portions are separated by only a small gap. This is to prevent handles getting tangled up during the manufacturing process.

SUMMARY OF THE INVENTION

Viewed from one aspect of the invention there is provided a binder clip comprising a clamping member having first and second side portions and a transverse portion, the first side portion being connected at a first end to one side of the transverse portion and having a second, free end, and the second side portion being connected at a first end to the other side of the transverse portion and having a second, free end; the first and second side portions converging and providing a clamping force so that an item positioned between the second ends of the side portions will be clamped; there being mounted to the second end of the first side portion a first handle which extends over the first side portion to a first actuating part beyond the transverse portion; and there being mounted to the second end of the second side portion a second handle which extends over the second side portion to a second actuating part beyond the transverse portion; characterized in that one leg of the first handle extends adjacent one edge of the first side portion of the clamping member to adjacent the first end of the first side portion and is then directed inwardly; and the other leg of the first handle extends adjacent the other edge of the first side portion of the clamping member to adjacent the first end of the first side portion and is then directed inwardly.

In some embodiments, a label holder is mounted on the first side portion in the space between the legs of the first handle.

In accordance with the invention, there is provided a significant free space between the two legs of the first handle extending across most of the width and height of the first side portion. This can be used to accommodate a label holder, as mentioned above, but it can be used alternatively to accommodate a label, information, advertising material, decorative material, text, at least one magnet for attaching the binder clip to a surface, and any other item or matter to be provided on the first side portion in the space between the legs of the first handle. This item or matter can be essentially planar or can project outwardly from the first side portion.

In accordance with the invention, as compared to U.S. Pat. No. 5,533,236 portions of the legs of the first handle do not extend diagonally across the face of the first side portion, but stay adjacent the edges of the first side portion. In the arrangement of U.S. Pat. No. 5,533,236, and other arrangements in which both handles have legs which converge from where they are attached to the free ends of the side portions of the clamping member, there is limited space for an item such as a label holder to be provided on a side portion, without it being partly obscured by the handle legs. Furthermore, when squeezing the handles together so as to open the side portions of the clip, the legs of the handle which overlie an item projecting from a side portion would bear down on the item, thus interfering with the operation of the clip and applying a force to the item which could cause damage or displacement of the item.

In some embodiments, said one leg of the first handle extends parallel to said one edge of the first side portion of the clamping member to adjacent the first end of the first side portion; and said other leg of the first handle extends parallel to said other edge of the first side portion of the clamping member to adjacent the first end of the first side portion. In some embodiments, said one leg of the first handle extends adjacent to and inside said one edge of the first side portion of the clamping member; and said other leg of the first handle extends adjacent to and inside said other edge of the first side portion of the clamping member.

In some embodiments, adjacent the first end of the first side portion said one leg of the first handle extends inwardly from adjacent said one edge of the first portion, before extending away from said first end of the first side portion to the first actuating part; and adjacent the first end of the first side portion said other leg of the first handle extends inwardly from adjacent said other edge of the first portion, before extending away from said first end of the first side portion to the first actuating part.

In some embodiments said one leg of the first handle and said other leg of the first handle converge from adjacent the first end of the first side portion to the first actuating part.

The second handle may have the same configuration as the first handle, and if desired the space between the two legs of the second handle can also be used to accommodate a label, a label holder, information, advertising material, decorative material, text and any other item or matter to be provided on the second side portion in the space between the legs of the second handle. Again, this matter can be essentially planar or can project outwardly from the second side portion. An item provided on the second side portion could be in the form of means for attaching the binder clip to a surface, such as an adhesive pad or at least one magnet, in the increased space between the legs of the handle.

In an alternative arrangement, the second handle may have a conventional configuration in which the two legs of the second handle converge across the second side portion, for example immediately from where they are attached to the second end of the side portion of the clamping member. An item provided on the second side portion in such an arrangement could be in the form of means for attaching the binder clip to a surface, such as an adhesive pad or at least one magnet. A magnet may be located in the space between the two legs of this conventional handle.

It will be appreciated that the side portions of the clamping member serve as jaws, between which items such as sheets of paper can be gripped. In this specification, the first side portion of the clamping member may be referred to as a first jaw, the expressions being used interchangeably, and the second side portion of the clamping member may be referred to as a second jaw, the expressions being used interchangeably.

In embodiments of the invention, there is provided a binder clip comprising a clamping member and first and second handles; wherein the clamping member comprises first and second jaws interconnected by a transverse portion, each jaw providing a face extending laterally between first and second side edges, and extending from a first end at the connection to the transverse portion to a second, free end remote from the transverse portion. Each handle comprises a member which has been bent to provide a pair of spaced legs which are connected to a gripping part, each leg terminating in a laterally directed end portion, which is received in a respective laterally directed jaw portion provided adjacent the free end of each jaw, between the side edges. A portion of each handle leg extends over the face of its respective jaw to adjacent a side edge of the jaw, in the region of the free end of the jaw. The first of said handles has a first leg with a first portion which extends adjacent the first edge of the first jaw of the clamping member, from the region of the free end of the first jaw to adjacent the transverse portion, and the first leg is then directed inwardly with respect to the first edge; and the second leg of the first handle has a second leg portion which extends adjacent the second edge of the first jaw of the clamping member, from the region of the free end of the first jaw to adjacent the transverse portion, and the second leg is then directed inwardly with respect to the second edge.

It is preferable that a portion of the first handle engages the clamping member in the region where the first jaw and the transverse portion meet; and that a portion of the second handle engages the clamping member in the region where the second jaw and the transverse portion meet. This provides fulcrum points when the first and second gripping parts are squeezed together.

Where it is said that the first and second leg portions extend adjacent the edges of the first jaw, this does not imply that they are immediately adjacent to those edges, although that is a possibility. They may be displaced somewhat from those edges. Indeed, wherever the word adjacent is used, this does not imply that one element is immediately adjacent to another element, although that is a possibility.

The legs may converge inwardly towards the gripping portion, from adjacent the transverse portion. In preferred embodiments, however, adjacent the transverse portion the first leg portion is connected to a third leg portion which is directed inwardly across the front face of the first jaw, preferably at a right angle to the first leg portion; and adjacent the transverse portion the second leg portion is connected to a fourth leg portion which is directed inwardly across the front face of the first jaw, preferably at a right angle to the second leg portion.

Preferably the third leg portion is connected to a fifth leg portion which is directed away from the third leg portion towards the first gripping part, and is connected to the first gripping part; and the fourth leg portion is connected to a sixth leg portion which is directed away from the fourth leg portion towards the first gripping part, and is connected to the first gripping part. Preferably the fifth and sixth leg portions converge towards the first gripping part.

The third leg portion may extend for between about 20% and about 35% of the width of the first jaw; the fourth leg portion may extend for between about 20% and about 35% of the width of the first jaw.

The mountings of the legs of each handle of the binder clip to their respective jaws, will permit pivotal movement so that each handle is pivotable between an operative condition in which the legs of the handle project towards and beyond the transverse portion, and an inoperative condition in which the legs of the handle project in the opposite direction. This may be achieved by means of terminal portions of the legs of the handle being received in portions on the jaw, which permit pivotal movement. The portions on the jaws which receive the terminal portions of the legs my be tubular, e.g. cylindrical. The expression "tubular" includes or "part tubular", i.e. an arrangement in which the wall of the tubular portion is not completely continuous and there is a gap. Typically, a tubular portion is formed by rolling round an end region of the jaw, and if this does not completely turn back on itself to meet the remaining part of the jaw, it will be part tubular.

It will be appreciated that the handles could have an arrangement as disclosed in U.S. Pat. No. 5,533,236, in which the legs terminate in laterally directed portions which are only separated by a small gap.

For a binder clip in accordance with the invention, the first leg portion and the second leg portion may each terminate immediately in a portion which is received in a portion on the jaws as described above. However, preferably the first leg portion terminates firstly in a first inwardly directed portion extending across the outer face of the first jaw, which is then connected to an outwardly extending first stub extending into a first tubular recess; and the second leg portion terminates firstly in a second inwardly directed portion extending across the outer face of the first jaw, which is then connected to an outwardly extending second stub extending into a second tubular recess.

In an arrangement in which there is a magnet on the first jaw or the second jaw, the magnet may be mounted on a wedge shaped member attached to the jaw. This wedge shaped member, which may be of plastics or any other material, will have its thicker end towards the free ends of the jaws and its thinner end towards the transverse portion. This wedge shaped member will be such that whole binder clip can be mounted on the surface with the transverse portion extending substantially perpendicular to the surface. Without the wedge shaped member, the transverse portion would be inclined downwardly from the perpendicular, and the jaw would tend to contact the surface only at the portions at the ends of the jaw which define the recesses to receive the ends of the handle legs, and where the jaw meets the transverse portion. Even if the transverse portion is not completely perpendicular to the surface, the wedge can be used to provide a flat portion in the space between the portions at the ends of the jaw which define the recesses to receive the ends of the handle legs, and where the jaw meets the transverse portion. Even if a wedge shaped member as such is not used, there may be an intermediate mounting platform between the magnet and the jaw, so enable the magnet to contact the surface.

It will be appreciated that in defining the invention in its broadest sense, the handles are described when they are in an operative position so that the gripping parts of the handles can be squeezed together to open the clip. However, the handles may be pivoted to inoperative positions as described above.

The various portions of the first leg, the second leg and the gripping part are preferably formed integrally as one piece. In a preferred embodiment they are formed integrally from a rod or wire of metal, such as steel, preferably of generally circular cross section, which has been bent into the correct shape.

Whilst the binder clip may be provided with no item or other matter on the outer surface of the first jaw, the invention extends to the binder clip which has an item or matter provided on the first jaw in the space between the two legs of the first handle. In some embodiments, the item or matter may be selected from a label, a label holder, information, advertising material, decorative material, a magnet or text.

An element, such as a decorative item or a label holder, may be attached to the clamping member by any suitable means, such adhesive and/or one or more portions on the item which are pressed into one or more corresponding apertures formed in the clamping member. In one preferred arrangement there are at least two spaced apertures in the first jaw of the clamping member. An item which is to be attached to the outer face of the first jaw is preferably provided with a corresponding plurality of spaced protrusions of deformable material which form a press fit into the apertures. The protrusions may have enlarged heads which engage against an inner face of the first jaw. The protrusions may be of a suitable plastics material, and for example may be molded integrally with a label holder or other item, of which a body part at least is preferably of plastic material. The protrusions will engage thinly in the apertures, particularly if the clamping member is made from spring steel or from another metal. There may be any number of protrusions, such as two or four.

An item in the form of a label holder may be of any desired type. It could be adapted to receive a slip of paper, card or plastics which can be written on before or after being inserted in the holder. Such a slip could be inserted into the label holder through a slot in the side, or could be pushed in from the front. It could have a permanent surface on which a label could be written using a marker pen. Typically a label holder will be of a plastics material, and will have a window in a front surface through which the label can be viewed. The label holder may have a rear face which is in contact with the surface of the first jaw. Alternatively, there may be no rear face, in which case the label holder is in the form of a frame surrounding the window and effectively the surface of the first jaw serves as the rear face of the label holder. In this case, protrusions on the label holder for attaching it to the first jaw are formed on the frame.

The label holder may contain any type of label, such as a date, a name, a photograph, text identifying the items held by the binder clip, or a combination of any of these.

In embodiments of the invention an item secured to the first jaw may have a width of at least about 50% or at least about 75% of the width of the first jaw.

A binder clip in accordance with the invention may be used to hold together, for example, sheets of paper. Alternatively, the binder clip could be used in combination with a board of a suitable material, such as wood, plastics or stiff cardboard, so has to support one or more sheets of paper on the board. This combination would thus serve as a clipboard. The binder clip could be attached to the board, either releasably or permanently.

Viewed from another aspect of the invention, there is provided a binder clip comprising first and second jaws having first ends between which there is defined an opening to receive an item, and second ends between which there is provided a resilient element biasing the opening to a closed condition, a first handle mounted by a first hinge adjacent the first end of the first jaw, and a second handle mounted by a second hinge adjacent the first end of the second jaw, so that each of the first and second handles is pivotable between an operative condition in which it projects towards and beyond the second ends of the jaws, and an inoperative condition in which it projects in an opposite direction; wherein the first handle has a first side portion which in the operative condition extends from adjacent the first hinge along a first side edge of the first jaw to adjacent the second end of the first jaw, and a second side portion which in the operative condition extends from adjacent the first hinge along a second side edge of the first jaw to adjacent the second end of the first jaw.

Viewed from another aspect of the invention, there is provided a binder clip comprising a clamping member and first and second handles; wherein the clamping member comprises first and second jaws interconnected by a transverse portion, each jaw providing a face extending laterally between first and second side edges, and extending from a first end at the connection to the transverse portion to a second, free end remote from the transverse portion; wherein each handle comprises a member which has been bent to provide a pair of spaced legs which are connected to a gripping part, each leg terminating in a laterally directed end portion, which is received in a respective laterally directed jaw portion provided adjacent the free end of each jaw, between the side edges; and wherein a portion of each handle leg extends over the face of its respective jaw to adjacent a side edge of the jaw, in the region of the free end of the jaw; characterised in that the first of said handles has a first leg with a first portion which extends adjacent the first edge of the first jaw of the clamping member, from the region of the free end of the first jaw to adjacent the transverse portion, and the first leg is then directed inwardly with respect to the first edge; and the second leg of the first handle has a second leg portion which extends adjacent the second edge of the first jaw of the clamping member, from the region of the free end of the first jaw to adjacent the transverse portion, and the second leg is then directed inwardly with respect to the second edge.

The optional features described above with reference to the first aspect of the invention are equally applicable to these further aspects of the invention.

BRIEF DESCRIPTION OF THE DRAWINGS

Embodiments of the invention will now be described by way of example and with reference to the accompanying drawings, in which.

DETAILED DESCRIPTION

Figure 1:
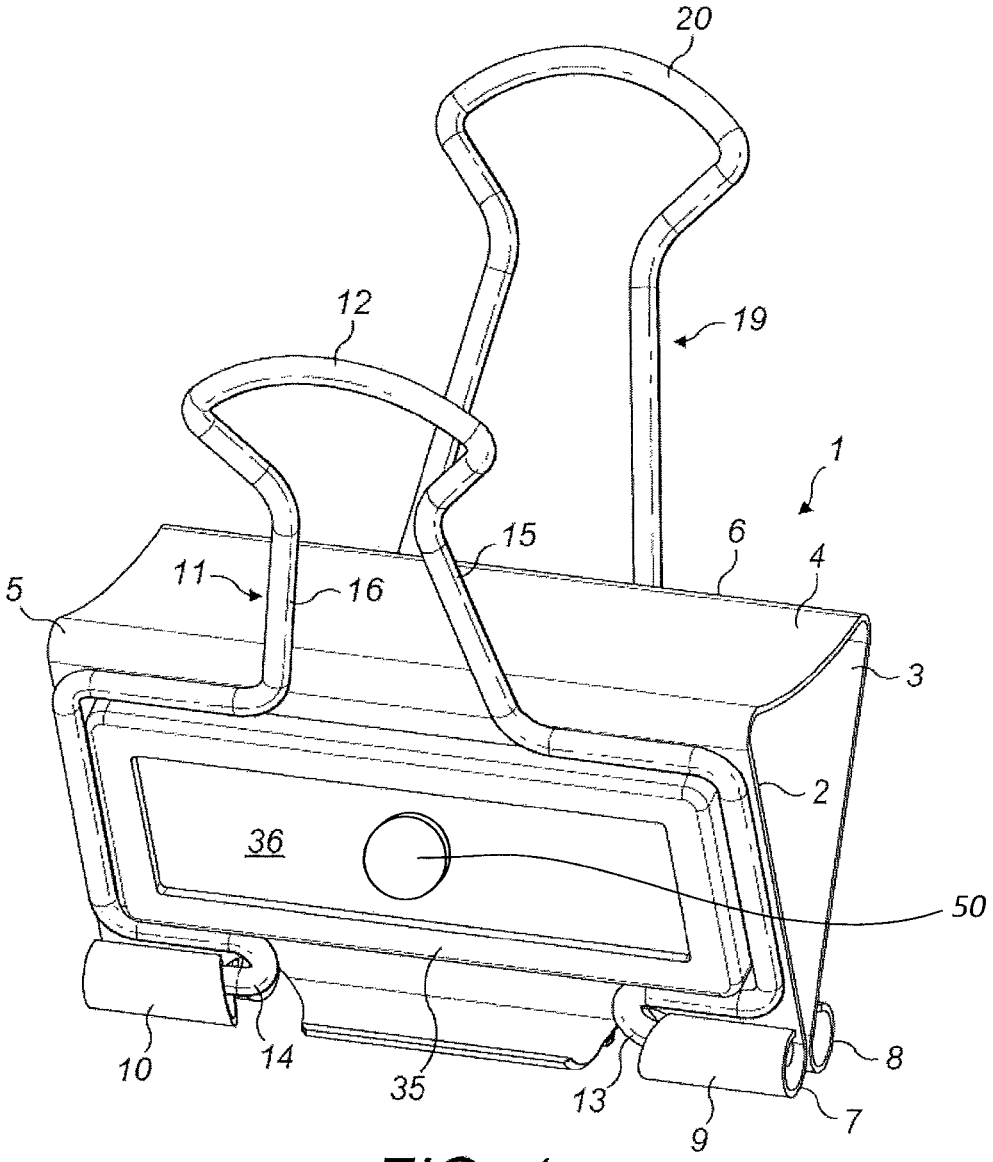
FIG. 1 is a front perspective view of a first embodiment of a binder clip in accordance with the invention.

Referring to the drawings, FIGS. 1 to 7 show a binder clip 1. This has a main body comprising a front jaw 2, a rear jaw 3, and a transverse portion 4. The upper end 5 of the front jaw 2 is connected to the transverse portion 4, and the upper end 6 of the rear jaw 3 is connected to the transverse portion 4. The font jaw 2, rear jaw 3 and transverse portion 4 are integrally formed from a suitable metallic material, such as spring steel, which has been bent to shape. The jaws 2 and 3 converge from their upper ends 5 and 6, to their lower ends 7 and 8, respectively. A shown most clearly in FIG. 6, the transverse portion 4 is bowed downwardly slightly between the jaws 2 and 3.

At its lower end the front jaw 2 has been curled round at one end to define a laterally extending, generally tubular portion 9, and has also been curled round at the other end to define a laterally extending, generally tubular portion 10. A front handle 11 with a gripping portion 12 is mounted to front jaw 2 in a hinged fashion by means of a laterally extending stub 13 projecting outwardly and engaging in tubular portion 9 and by means of a laterally extending stub 14 projecting outwardly and engaging in tubular portion 10. Stub 13 is at the bottom of a leg 15 extending from the gripping portion 12, and stub 14 is at the bottom of a leg 16 extending from the gripping portion 12.

Figure 3:
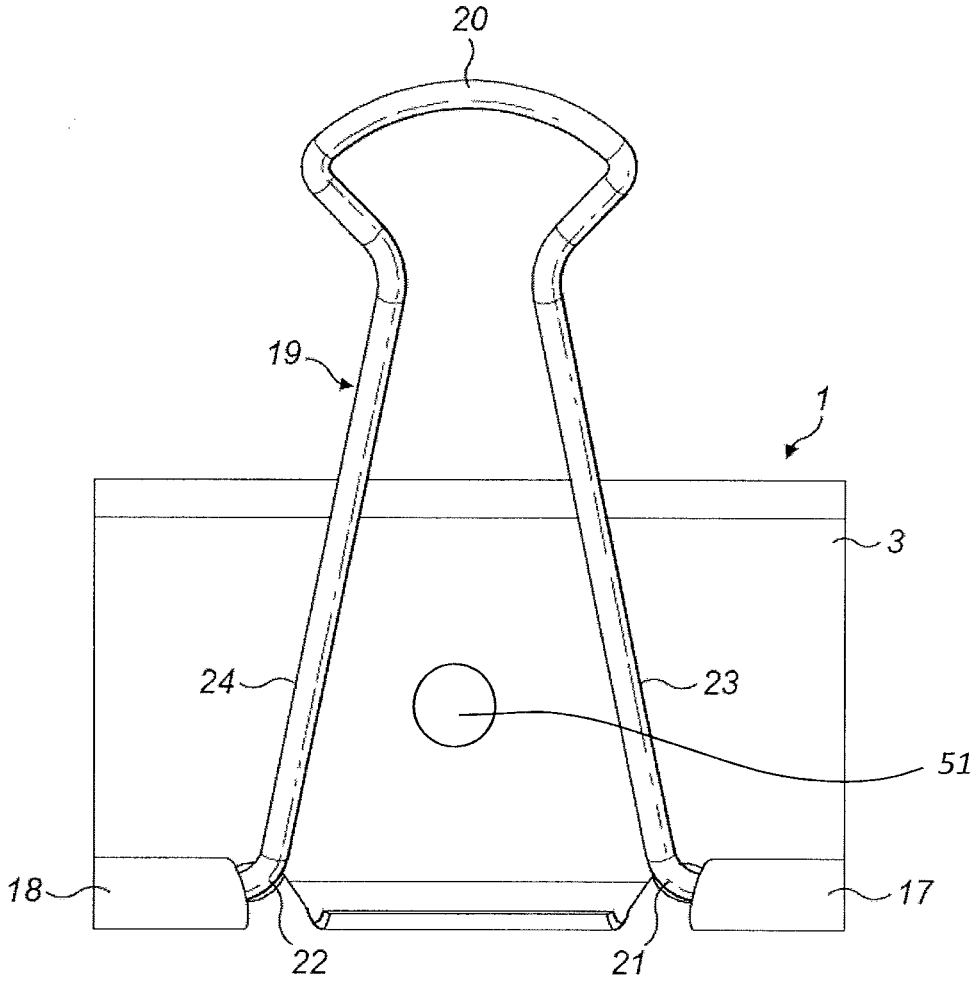
FIG. 3 is a rear view of the binder clip.

As shown in FIG. 3, at its lower end the rear jaw 3 has been curled round at one end to define a laterally extending, generally tubular portion 17, and has also been curled round at the other end to define a laterally extending, generally tubular portion 18. A rear handle 19 with a gripping portion 20 is mounted to rear jaw 3 in a hinged fashion by means of a laterally extending stub 21 projecting outwardly and engaging in tubular portion 17 and by means of a laterally extending stub 22 projecting outwardly and engaging in tubular portion 18. Stub 21 is at the bottom of a leg 23 extending from the gripping portion 20, and stub 22 is at the bottom of a leg 24 extending from the gripping portion 20. The rear handle is of a conventional shape, as on known binder clip, and the legs converge from stubs 21 and 22, towards the gripping portion 20. The front handle 11 is configured differently.

Figure 2:
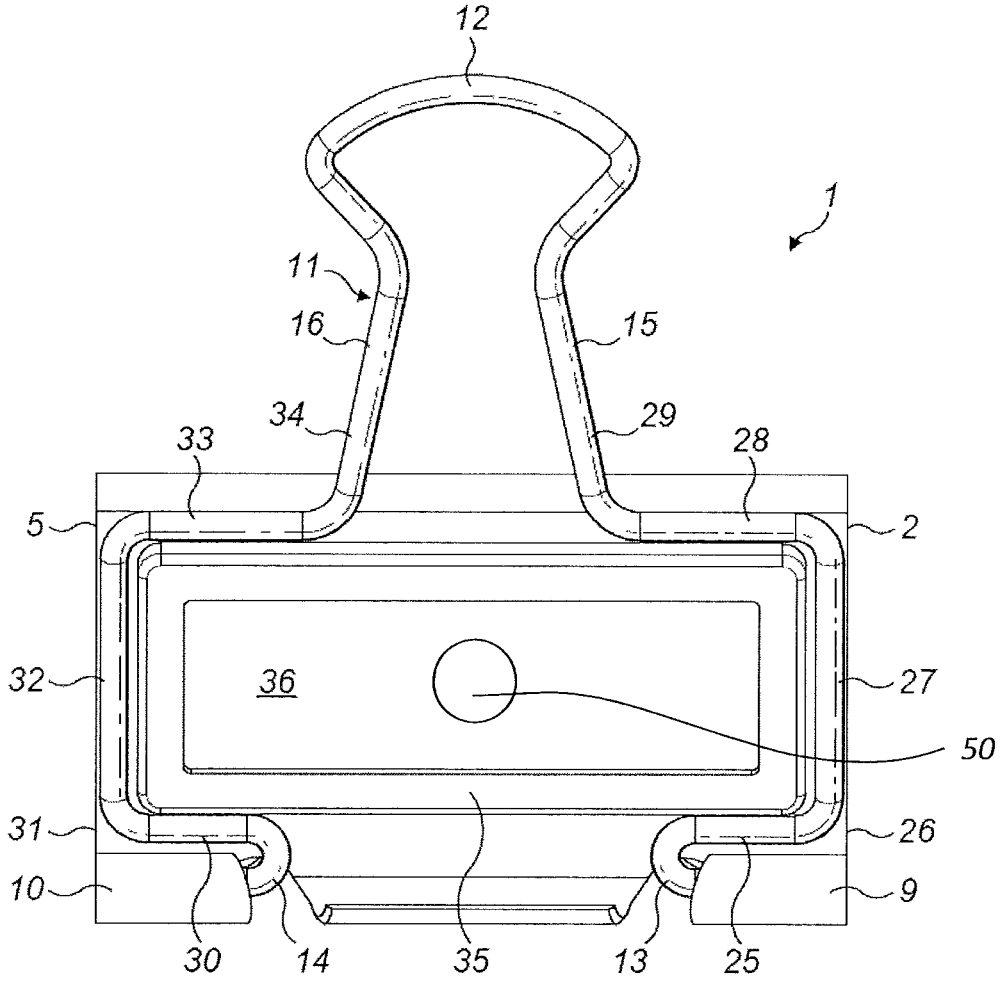
FIG. 2 is a front view of the binder clip.
Figure 4:
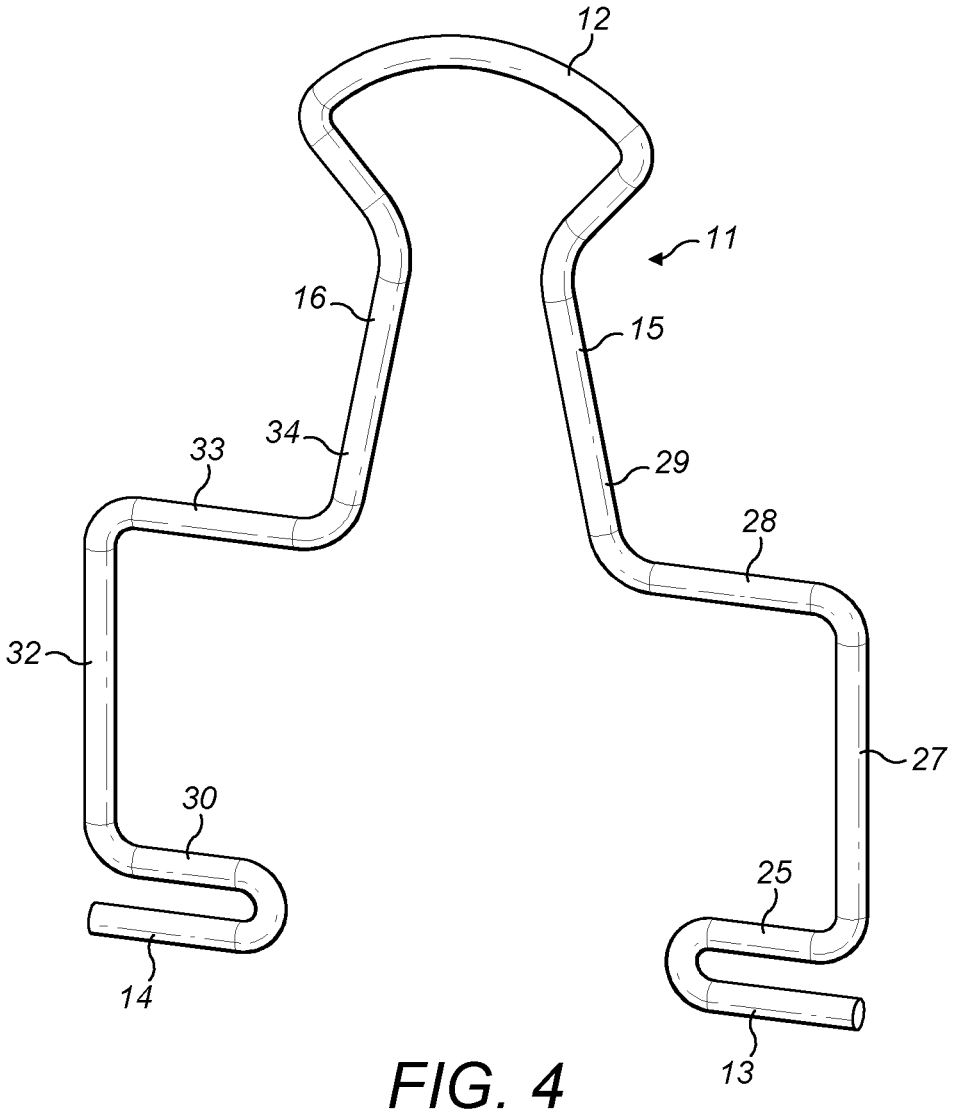
FIG. 4 is view of one of the handles of the binder clip.
Figure 5:
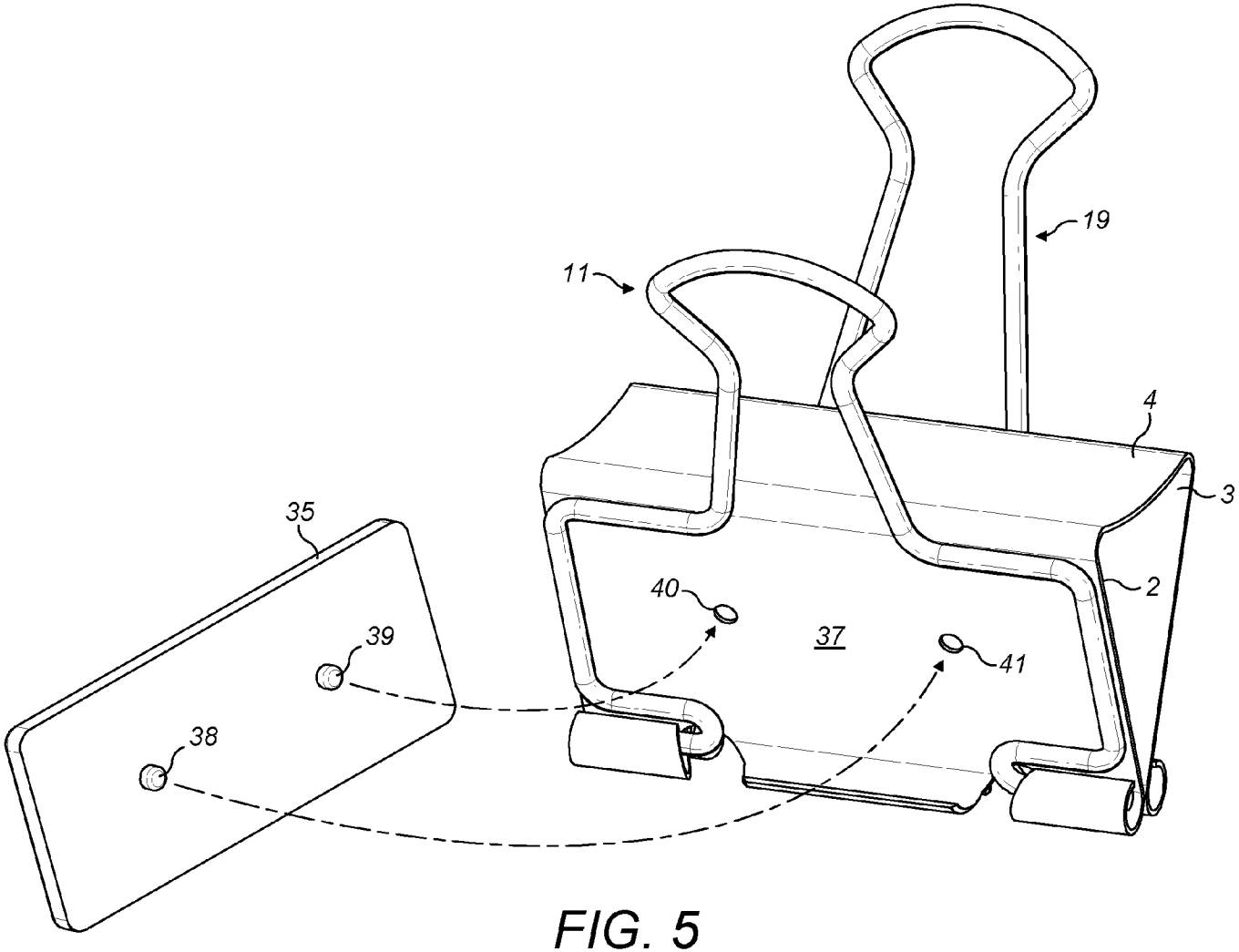
FIG. 5 is a view showing how the label holder is attached to the binder clip.
Figure 6:
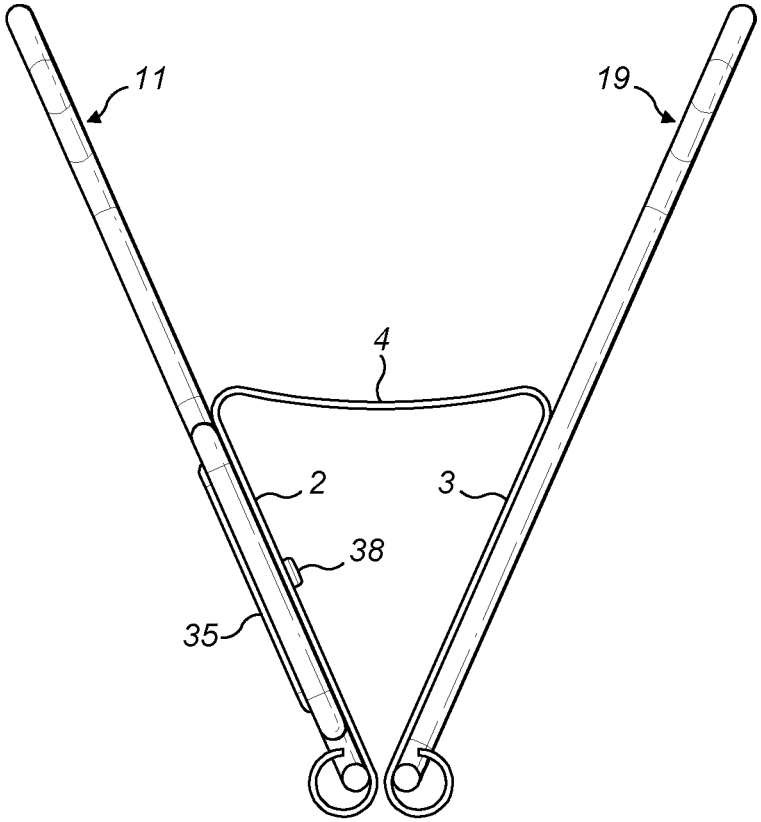
FIG. 6 is an end view of the binder clip.

As shown most clearly in FIGS. 2 and 4, from the stub 13 the front handle 11 is bent back on itself to form a laterally outwardly directed portion 25 which extends towards the right edge 26 of the front jaw 2. This portion 25 is then connected at right angles to an upwardly extending portion 27 which extends adjacent to, and parallel to, the right edge 26 of front jaw 2. Portion 27 continues to adjacent the upper end 5 of the front jaw 2, when it is then connected at right angles to a laterally inwardly directed portion 28 which extends across the front jaw 2 parallel to the upper end 5 of the front jaw, for approximately one third of the width of the front jaw 2. This portion 28 is then connected to an upwardly extending portion 29 which extends to the gripping portion 12. In a similar manner, from the stub 14 the front handle 11 is bent back on itself to form a laterally outwardly directed portion 30 which extends towards the left edge 31 of the front jaw 2. This portion 30 is then connected at right angles to an upwardly extending portion 32 which extends adjacent to, and parallel to, the left edge 31 of front jaw 2. Portion 32 continues to adjacent the upper end 5 of the front jaw 2, when it is then connected at right angles to a laterally inwardly directed portion 33 which extends across the front jaw 2 parallel to the upper end 5 of the front jaw, for approximately one third of the width of the front jaw 2. This portion 33 is then connected to an upwardly extending portion 34 which extends to the gripping portion 12. Portions 28 and 34 converge towards the gripping portion 12.

The front handle 11 is made from a single length of steel wire or the like which has been bent to provide the portions referred to above. Similarly, rear handle 19 is made from a single length of steel wire or the like which has been bent to provide the portions referred to above.

It will thus be observed that whilst the legs 23 and 24 of the rear handle 19 extend across the face of the rear jaw 3, the legs 15 and 16 of the front handle 11 extend around the face of the front jaw 2, leaving a substantial, generally rectangular, clear space in the region defined between portions 25 and 28; 30 and 33; and 27 and 32. As described above, magnets (e.g., magnets 50, 51 as shown in FIGS. 1-3) may be located in this space. This space may be used to accommodate a rectangular label holder 35, of plastics material, which holds a label 36 that can be viewed through a window of the label holder. The label holder is fixed to the front face 37 of the front jaw 2, by means of two plastic pegs 38, 39 formed integrally on the rear of the holder which engage in apertures 40 and 41 punched in the front face 37 of the front jaw 20. The pegs are compressed as they pass the through apertures, and provide a gripping force against the walls of the apertures, and then the ends of the pegs expand when they are free of the apertures, to assist in locating the label holder.

Figure 7:
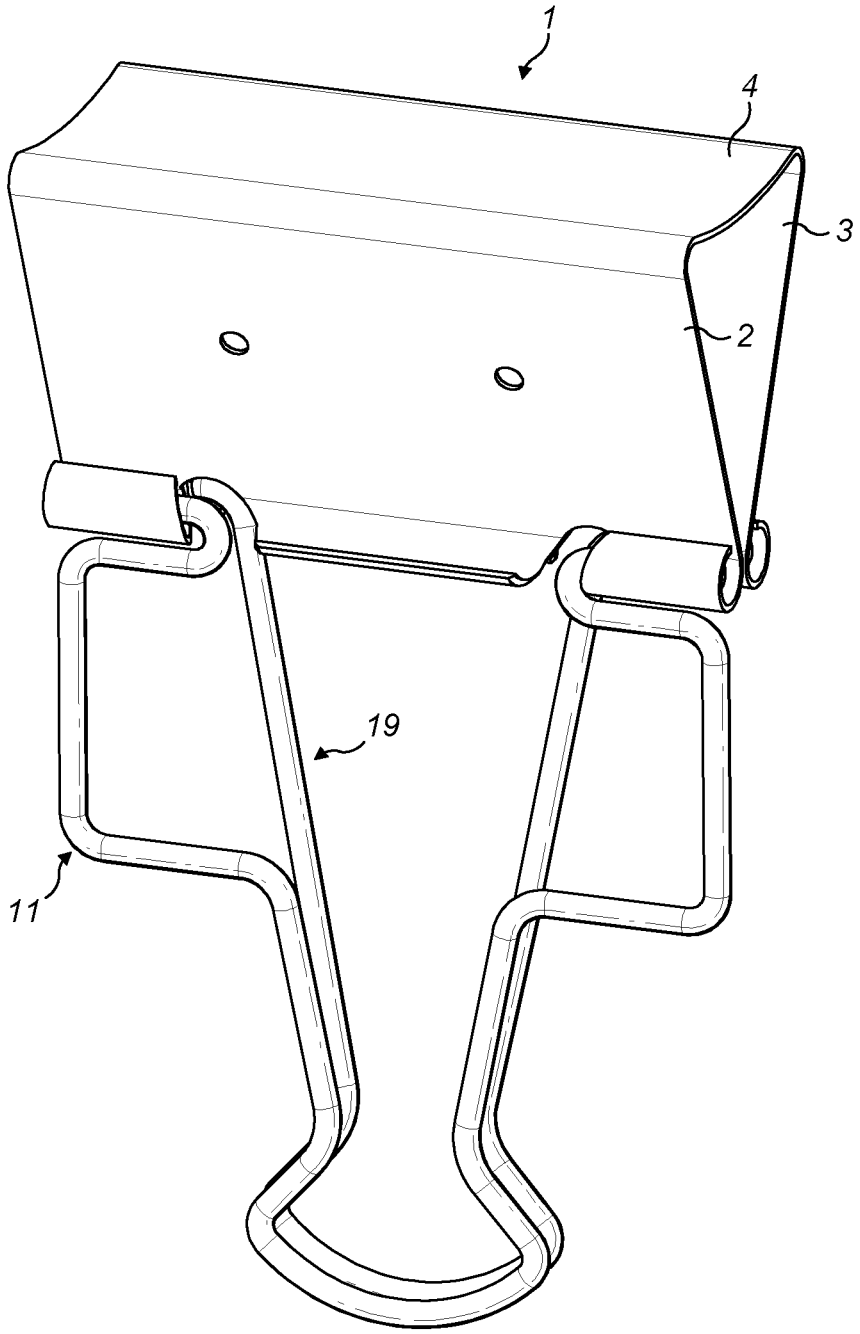
FIG. 7 shows the handles of the binder clip in an alternative position.

FIG. 7 shows the binder clip, without the label holder in place, with the handles 11 and 19 pivoted to an alternative position, in which they project away from the jaws 2 and 3.

Figure 8:
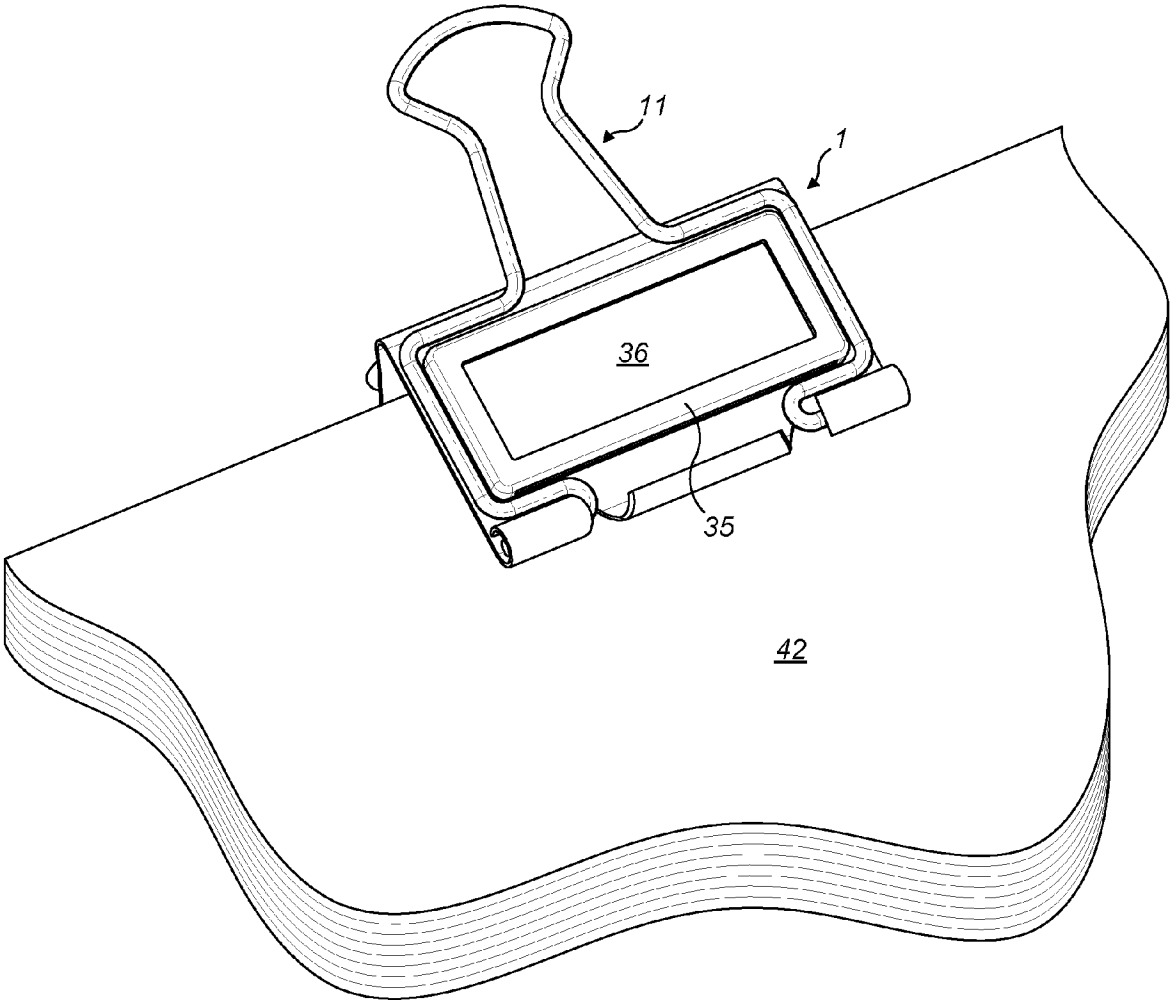
FIG. 8 shows the binder clip in use.
Figure 9:
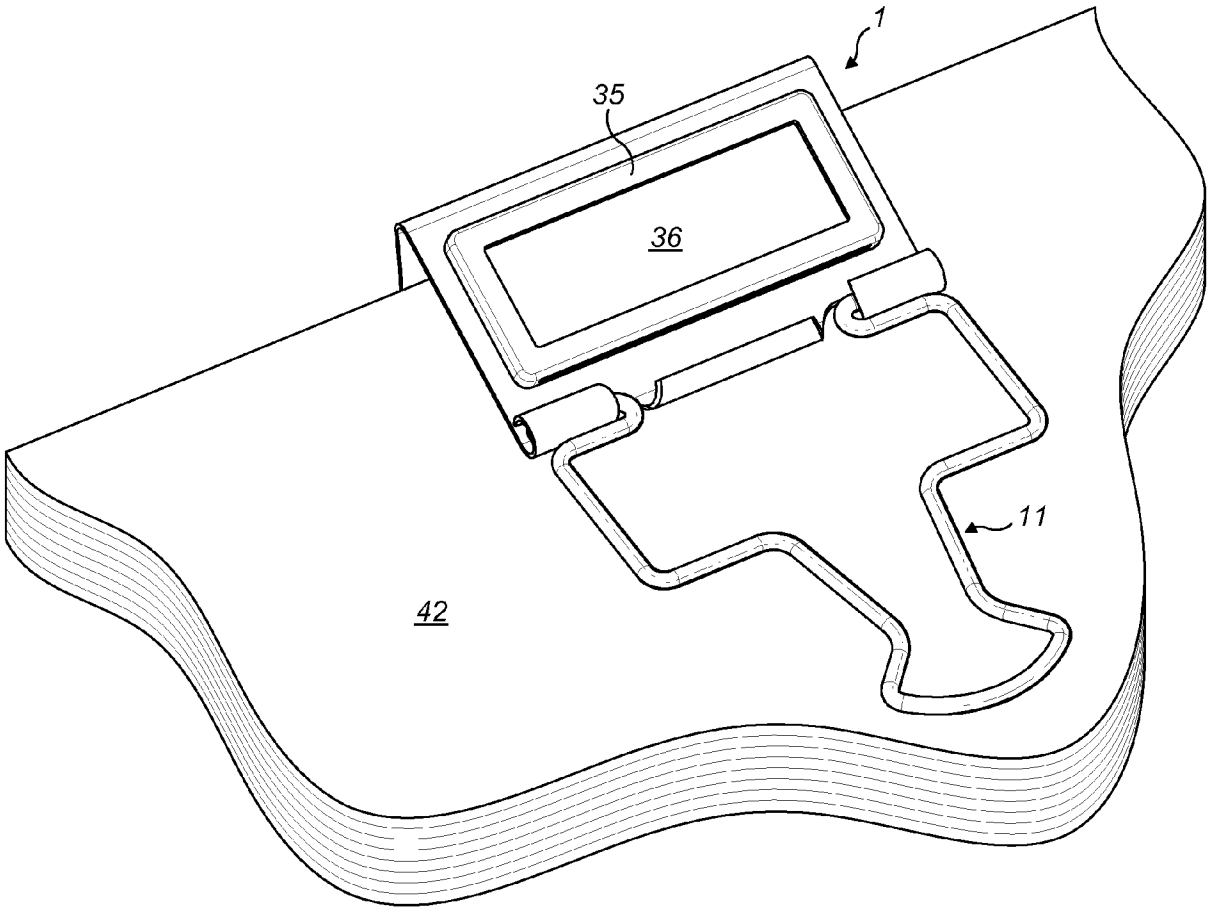
FIG. 9 shows binder clip in use with a handle in an alternative position.

FIG. 8 shows the binder clip 1 used to hold a bundle of sheets of paper 42 together. The label holder 35 is uppermost, with the label 36 unobstructed with the handle 11 in the position shown, where it does not extend over the bundle of papers 42 and thus obstruct any matter on the top sheet or hinder access to other sheets. The handle 11 can also be folded down to the position shown in FIG. 9, where it extends over the papers 42 and may obstruct matter on the top sheet or hinder access to other sheets. In this position, the binder clip may be more suitable for transport or packing into a case or bag, as the handles do not project outwardly.

Figure 10:
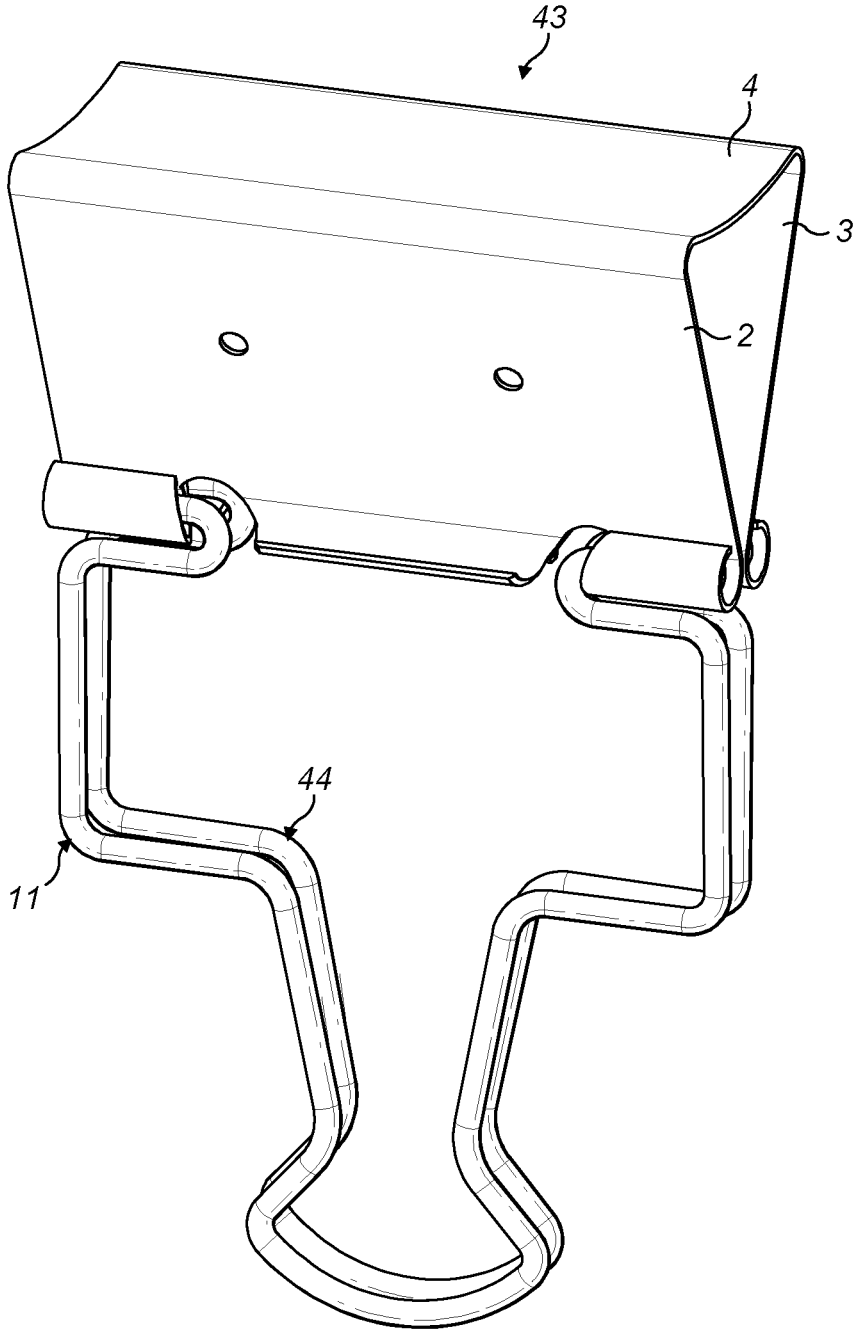
FIG. 10 shows an alternative embodiment of binder clip.

FIG. 10 shows an alternative embodiment of binder clip 43, without a label holder in place. In this case the main body of the clip, forming front jaw 2, rear jaw 3 and transverse portion 4, is the same as the previous embodiment, as is the front handle 11. However, the rear handle 44 is not of a conventional shape like rear handle 19 in the previous embodiment, but is the same shape as handle 11 in the previous embodiment.

Figure 11:
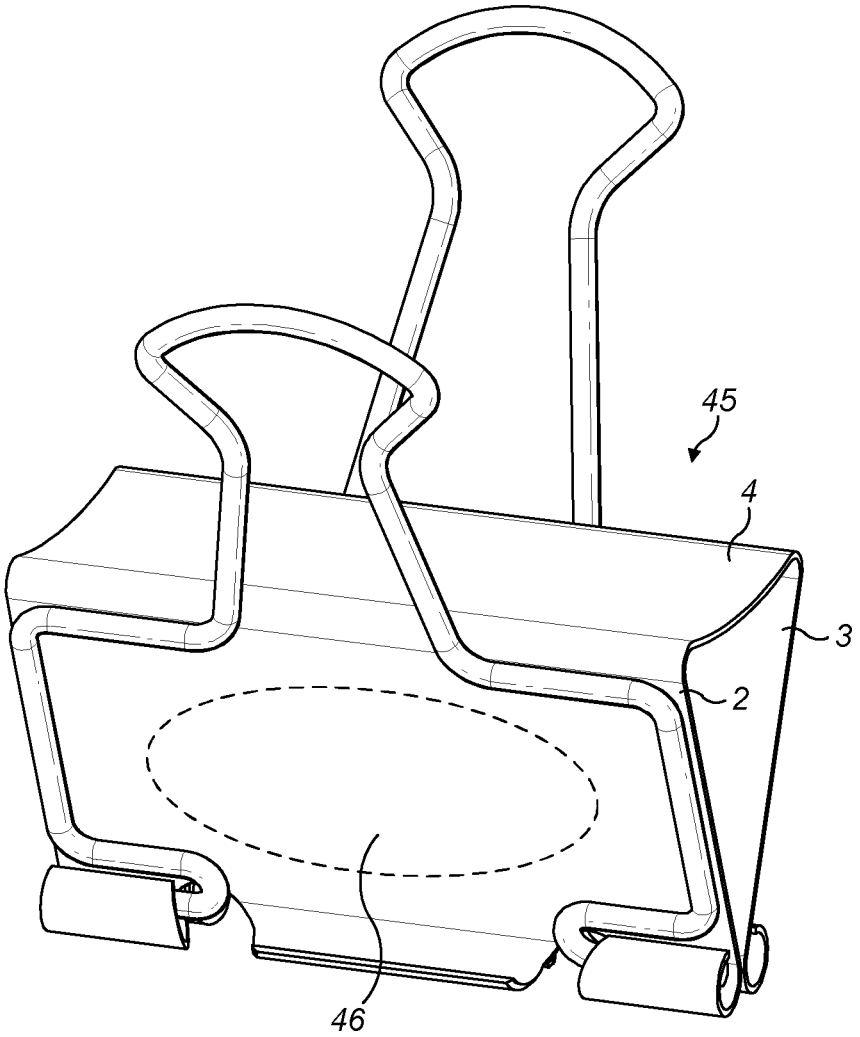
FIG. 11 shows another alternative embodiment of binder clip.

FIG. 11 shows another embodiment of binder clip 45 which identical the binder clip 1 described above, save that there is not label holder and there are no apertures in the face of front jaw 2. Instead, binder clip 45 can be used as a conventional binder clip, or alternatively any desired object may be attached to the front face of front jaw 2, for example in the region 46 indicated by a dotted line, by any desired method such as adhesive.

Thus, in accordance with the invention there is provided a binder clip comprising a clamping member of spring steel having jaws interconnected by a transverse portion, and a pair of handles each formed of two legs mounted at spaced positions to adjacent the free ends of the jaws. A portion of one leg of one handle extends adjacent one edge of a jaw of the clamping member to adjacent the transverse portion, where another portion of the leg is directed inwardly; and a portion of the other leg of that handle extends adjacent the other edge of the jaw of the clamping member to adjacent the transverse portion, where another portion of the other leg is directed inwardly. There is thus provided a space between the two legs so that an element such as a label holder can be mounted on the jaw of the clamping member, without interference from the legs of the handle.

What is claimed is:

1. A binder clip comprising a clamping member having first and second jaws and a transverse portion, the first jaw being connected at a first end to one side of the transverse portion and having a second, free end, and the second jaw being connected at a first end to an other side of the transverse portion and having a second, free end; the first and second jaws converging and providing a clamping force so that an item positioned between the second ends of the jaws will be clamped; there being mounted to the second end of the first jaw a first handle which extends over the first jaw to a first actuating part beyond the transverse portion; and there being mounted to the second end of the second jaw a second handle which extends over the second jaw to a second actuating part beyond the transverse portion; characterised in that one leg of the first handle extends adjacent one edge of the first jaw of the clamping member to adjacent the first end of the first jaw and is then directed inwardly; and an other leg of the first handle extends adjacent an other edge of the first jaw of the clamping member to adjacent the first end of the first jaw and is then directed inwardly; wherein a label holder is mounted on the first jaw in a space between the legs of the first handle.

2. A binder clip as claimed in claim 1, wherein said one leg of the first handle extends parallel to said one edge of the first jaw of the clamping member to adjacent the first end of the first jaw; and said other leg of the first handle extends parallel to said other edge of the first jaw of the clamping member to adjacent the first end of the first jaw.

3. A binder clip as claimed in claim 2 wherein said one leg of the first handle extends adjacent to and inside said one edge of the first jaw of the clamping member; and said other leg of the first handle extends adjacent to and inside said other edge of the first jaw of the clamping member.

4. A binder clip as claimed in claim 3, wherein adjacent the first end of the first jaw said one leg of the first handle extends inwardly from adjacent said one edge of the first jaw, before extending away from said first end of the first jaw to the first actuating part; and adjacent the first end of the first jaw said other leg of the first handle extends inwardly from adjacent said other edge of the first jaw, before extending away from said first end of the first jaw to the first actuating part.

5. A binder clip as claimed in claim 4, wherein said one leg of the first handle and said other leg of the first handle converge to the first actuating part.

6. A binder clip as claimed in claim 1, wherein adjacent the first end of the first jaw said one leg of the first handle extends inwardly from adjacent said one edge of the first jaw, before extending away from said first end of the first jaw to the first actuating part; and adjacent the first end of the first jaw said other leg of the first handle extends inwardly from adjacent said other edge of the first jaw, before extending away from said first end of the first jaw to the first actuating part.

7. A binder clip as claimed in claim 1, wherein each leg of the first handle terminates in a laterally directed end portion, which is received in a respective laterally directed jaw portion provided adjacent the free end of each jaw.

8. A binder clip as claimed in claim 1, wherein a first leg of the first handle has a first leg portion which extends adjacent a first edge of the first jaw of the clamping member, from a region of the free end of the first jaw to adjacent the transverse portion; a second leg of the first handle has a second leg portion which extends adjacent a second edge of the first jaw of the clamping member, from the region of the free end of the first jaw to adjacent the transverse portion; adjacent the transverse portion the first leg portion is connected to a third leg portion which is directed inwardly across a front face of the first jaw; adjacent the transverse portion the second leg portion is connected to a fourth leg portion which is directed inwardly across the front face of the first jaw; the third leg portion is connected to a fifth leg portion which is directed away from the third leg portion towards a first gripping part, and is connected to the first gripping part; and the fourth leg portion is connected to a sixth leg portion which is directed away from the fourth leg portion towards the first gripping part, and is connected to the first gripping part.

9. A binder clip as claimed in claim 8, wherein the fifth and sixth leg portions converge towards the first gripping part.

10. A binder clip as claimed in claim 8, wherein an end of the first leg portion is pivotally connected to the first jaw, and an end of the second leg portion is pivotally connected to the first jaw.

11. A binder clip as claimed in claim 10, wherein the first leg portion terminates in a first inwardly directed portion extending across an outer face of the first jaw, which is then connected to an outwardly extending first stub extending into a first tubular recess formed on the first jaw; and the second leg portion terminates in a second inwardly directed portion extending across the outer face of the first jaw, which is then connected to an outwardly extending second stub extending into a second tubular recess formed on the first jaw.

12. A binder clip comprising a clamping member having first and second jaws and a transverse portion, the first jaw being connected at a first end to one side of the transverse portion and having a second, free end, and the second jaw being connected at a first end to an other side of the transverse portion and having a second, free end; the first and second jaws converging and providing a clamping force so that an item positioned between the second ends of the jaws will be clamped; there being mounted to the second end of the first jaw a first handle which extends over the first jaw to a first actuating part beyond the transverse portion; and there being mounted to the second end of the second jaw a second handle which extends over the second jaw to a second actuating part beyond the transverse portion; characterised in that one leg of the first handle extends adjacent one edge of the first jaw of the clamping member to adjacent the first end of the first jaw and is then directed inwardly; and an other leg of the first handle extends adjacent an other edge of the first jaw of the clamping member to adjacent the first end of the first jaw and is then directed inwardly, wherein an item is provided on the first jaw in a space between the two legs of the first handle, the item projecting outwardly from the first jaw.

13. A binder clip as claimed in claim 12, wherein the item is selected from a label, a label holder or a decorative item.

14. A binder clip as claimed in claim 12 wherein a magnet is provided on the first jaw in the space between the two legs of the first handle.

15. A binder clip comprising a clamping member having first and second jaws and a transverse portion, the first jaw being connected at a first end to one side of the transverse portion and having a second, free end, and the second jaw being connected at a first end to an other side of the transverse portion and having a second, free end; the first and second jaws converging and providing a clamping force so that an item positioned between the second ends of the jaws will be clamped; there being mounted to the second end of the first jaw a first handle which extends over the first jaw to a first actuating art be and the transverse portion; and there being mounted to the second end of the second jaw a second handle which extends over the second jaw to a second actuating part beyond the transverse portion; characterised in that one leg of the first handle extends adjacent one edge of the first jaw of the clamping member to adjacent the first end of the first jaw and is then directed inwardly; and an other leg of the first handle extends adjacent an other edge of the first jaw of the clamping member to adjacent the first end of the first jaw and is then directed inwardly, wherein a magnet is provided on the second jaw.

16. A binder clip comprising a clamping member having first and second jaws and a transverse portion, the first jaw being connected at a first end to one side of the transverse portion and having a second, free end, and the second jaw being connected at a first end to an other side of the transverse portion and having a second, free end; the first and second jaws converging and providing a clamping force so that an item positioned between the second ends of the jaws will be clamped; there being mounted to the second end of the first jaw a first handle which extends over the first jaw to a first actuating part beyond the transverse portion; and there being mounted to the second end of the second jaw a second handle which extends over the second jaw to a second actuating part beyond the transverse portion; characterised in that one leg of the first handle extends adjacent one edge of the first jaw of the clamping member to adjacent the first end of the first jaw and is then directed inwardly; and an other leg of the first handle extends adjacent an other edge of the first jaw of the clamping member to adjacent the first end of the first jaw and is then directed inwardly, wherein matter is provided on a surface of the first jaw in a space between the two legs of the first handle, the matter being selected from information, advertising material or decorative material.

* * * * *